United States Patent [19]

Häggqvist

[11] Patent Number: 4,648,221

[45] Date of Patent: Mar. 10, 1987

[54] DEVICE FOR FASTENING AN ADDITIONAL PANE IN A WINDOW

[75] Inventor: Alf Häggqvist, Värnamo, Sweden

[73] Assignee: AB Varnamo Gummifabrik, Värnamo, Sweden

[21] Appl. No.: 574,239

[22] Filed: Jan. 26, 1984

[30] Foreign Application Priority Data

Jan. 28, 1983 [SE] Sweden ..... 8300437

[51] Int. Cl.[4] ..... E06B 3/28

[52] U.S. Cl. ..... 52/202

[58] Field of Search ..... 52/202, 203

[56] References Cited

U.S. PATENT DOCUMENTS 1,394,237 10/1921 Valade ..... 52/203
4,089,143 5/1978 LaPietra ..... 52/202 X
4,335,552 6/1982 Blanchett et al. ..... 52/202

FOREIGN PATENT DOCUMENTS 2264163 10/1975 France ..... 52/203
2332407 6/1977 France ..... 52/203

*Primary Examiner*—J. Karl Bell
*Attorney, Agent, or Firm*—Pollock, Vande Sande & Priddy

[57] ABSTRACT

A device for mounting or fastening of an additional glass panel into an existing window opening of a window frame which provides effective sealing of the space between the additional panel and the existing glass panel.

A strip arrangement of the device includes a sealing portion which sealingly contacts a previously mounted glass panel and fastening elements for retaining the strip arrangement and additional glass panel in a position in which the sealing portion sealingly engages the existing glass panel in the window opening.

2 Claims, 3 Drawing Figures

DEVICE FOR FASTENING AN ADDITIONAL PANE IN A WINDOW

The present invention relates to a device for mounting or fastening an additional glass panel in a window opening of a window frame or the like.

The increasing energy costs bring about an increasing demand for an effective insulation of dwellings and premises. With regard thereto it is usually desirable that the windows of dwellings and premises are of the three glass panel type or at least of the two glass panel type. In the case that the costs for replacing the existing windows on windows having a larger number of glass panels are for different reasons considered to be too high, it is an alternative solution to provide the already existing windows with an additional glass panel.

Different devices for mounting an additional glass panel in a window opening of a window frame or the like are previously known. However, these devices have not been used to any larger extend as they have substantial drawbacks. The previously known devices are clumsy and difficult to mount and have substantial drawbacks with regard to the capacity of sealing the space between the additional glass panel and the adjacent glass panel already mounted in the window opening. The last mentioned fact leads to a reduced improvement of the insulating capacity as well as to the creation of a moisture covering on the glass panel which blocks the view through the glass panels.

The object of the present invention is to provide a device for mounting or fastening an additional glass pane in a window opening of a window frame or the like which device is easy to mount and provides an effective sealing of the space between the additional glass panel and the adjacent glass panel already present in the window opening.

In order to comply with this object the device for mounting or fastening an additional glass panel in a window opening of a window frame or the like comprises a strip arrangement for receiving the edge portion of the additional glass panel, the fastening device according to the invention being characterized in that the strip arrangement comprises a sealing portion adapted sealingly to contact a glass panel previously mounted or fastened in the window opening and that the fastening device comprises fastening elements for retaining the strip arrangement and the additional glass panel supported thereby in a position in which the sealing portion of the strip arrangement sealingly engages the glass panel previously fastened or mounted in the window opening.

In accordance with the invention a completely smooth sealing surface which formed by the previously mounted glass panel in the window opening is used and in a simple and effective way provides for complete sealing of the space between the newly mounted glass panel and the existing adjacent glass panel. This provides for substantial improvement in the window insulating capacity and moisture and dirt are prevented from entering the space between the glass panels which would reduce the view through the window.

In a preferred embodiment of the present invention, the fastening elements and strip arrangement comprise engagement portions which are adapted to engage each other in a predetermined relative position between the fastening elements and the strip arrangement in order to fix the strip arrangement. It is therefore easy to mount the fastening device so that contact between the sealing portion of the strip arrangement and the previously mounted glass panel in the window opening is secure, such contact being necessary to provide sufficient sealing between the newly mounted glass panel and the previously mounted glass panel in the window opening.

It is a preferred object of the invention that the sealing elements can be affixed to surfaces connected with the window opening in predetermined positions in relation to the previously mounted glass panel in the window opening since each fastening element has an engagement portion which is adapted to contact the previously mounted glass panel in the window opening when the fastening elements are fixed to the surfaces positioned in connection with the window opening. Thus, according to the invention the previously mounted glass panel in the window opening is utilized as a sealing surface to enable sealing of the space between the newly mounted glass panel and the previously mounted glass panel in the window opening and to define the correct position of the fastening elements. It is clear that it is therefore easy to define the strip arrangement position in the window opening in an extremely accurate manner so that satisfactory tightness is provided.

The invention is described as follows with reference to the accompanying drawings.

DETAILED DESCRIPTION OF THE PREFERRED EMBODIMENT

Figure 1:
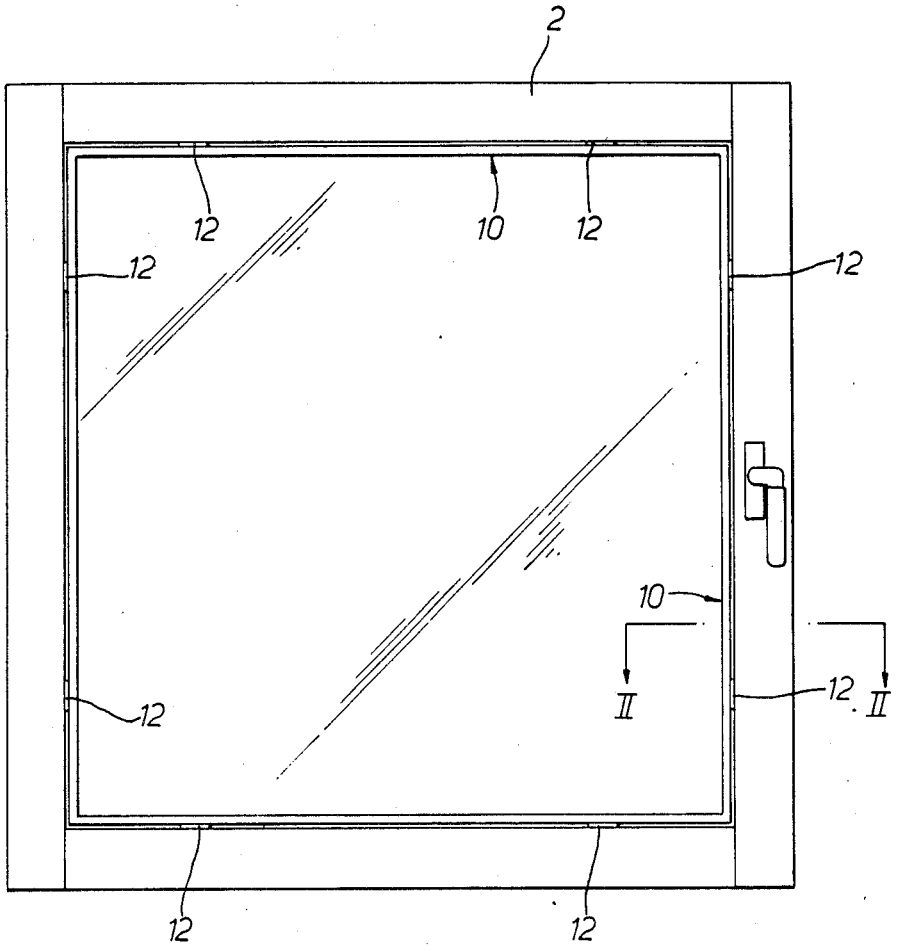
FIG. 1 is a plan view of a window frame provided with an additional glass panel by means of a fastening device according to the invention.
Figure 2:
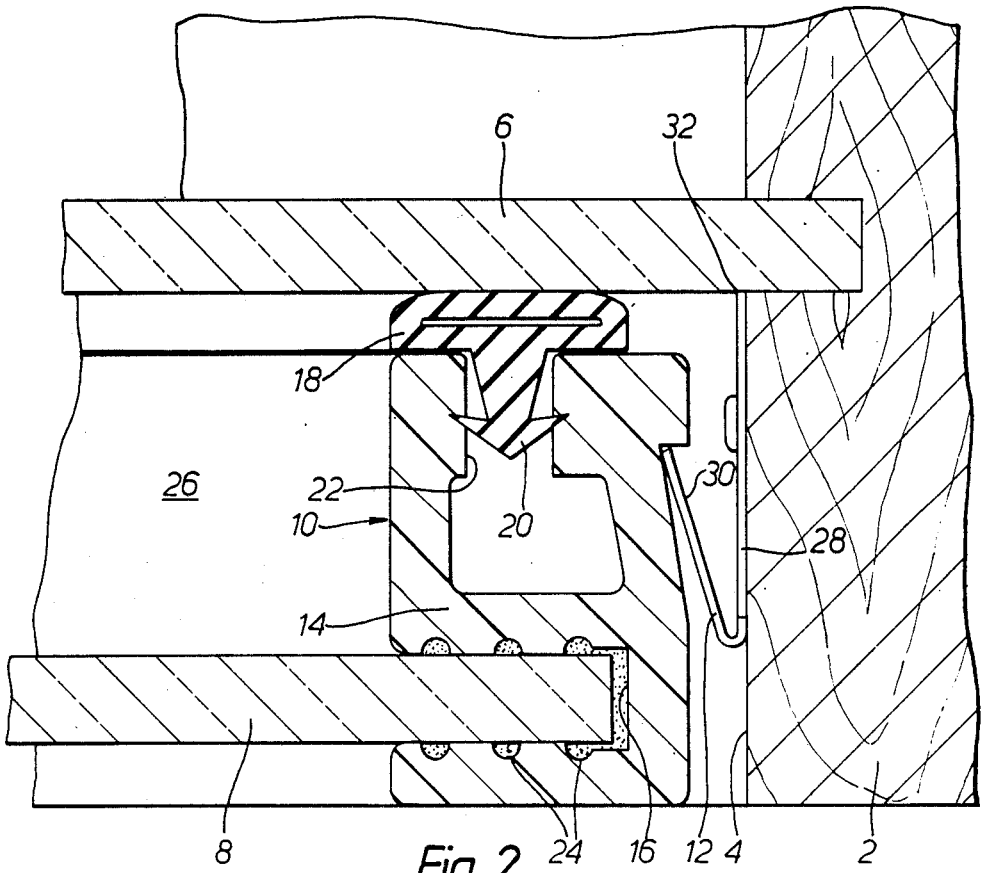
FIG. 2 is a section on line II—II of FIG. 1 on an enlarged scale.
Figure 3:
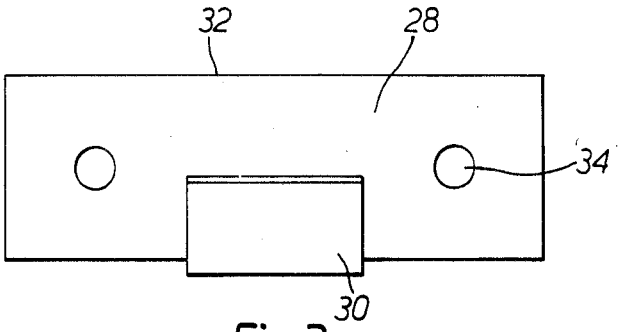
FIG. 3 shows a fastening element included in the fastening device according to the invention on an enlarged scale.

A window frame 2, shown in FIGS. 1 and 2 defines a window opening at its inner surface 4. A glass panel 6 is mounted in the window frame 2 in a conventional way. For example the window frame 2 can constitute the inner frame of two window frames connected with each other and constituting a conventional double frame window. Thus, a window of this kind comprises two glass panels mounted in an inner frame and an outer frame of the window, respectively. In order to improve the insulating capacity of the double frame window it is possible to provide the inner frame 2 with an additional glass panel by means of the fastening device of the present invention so that the window becomes a three glass panel window.

The fastening device for mounting an additional glass panel 8 in the window frame 2 comprises a strip arrangement 10 and a number of fastening elements 12. Strip arrangement 10 consists of an elastic material and comprises a main portion 14 having a groove 16 for receiving the edge portion of the additional glass panel 8 and a sealing portion 18. Sealing portion 18 is connected with the main portion 14 by means of portion 20 which has an arrow-shaped section and engages groove 22 in the main portion 14. Preferably main portion 14 of strip arrangement 10 consists of a relatively hard plastic material which provides sufficient stability of strip arrangement 10. A suitable material for the main portion is polyvinyl chloride which should preferably be UV-stabilized. Preferably the sealing portion 18 consists of a more pliable elastic material having good resistance to aging. A suitable material for the sealing portion 18 is silicone rubber. Groove 16 for receiving the edge portion of the additional glass panel is formed with grooves 24 having the object of improving the adhesion to a glue, for example silicone glue, which is preferred for providing a tight connection of the edge portion of the glass panel to the strip arrangement 10.

Sealing of space 26 between glass panel 6 and additional glass panel 8 in window frame 2 is provided by engagement of the edge portion of the additional glass panel 8 in groove 16 of main portion 14 as described above and by sealing portion 18 of the strip arrangement 10 which engages glass panel 6.

Strip arrangement 10 and the additional glass panel 8 mounted therein are fixed in a position in which sealing portion 18 sealingly engages glass panel 6 by fastening elements 12. Preferably, fastening elements 12 are metal but it is also possible that fastening elements 12 may be manufactured of high strength plastic material. Each of fastening elements 12 comprises a retainer portion 28 and a leg 30 resiliently connected therewith. Fastening elements 12 are connected with window frame 2 so that retainer portion 28 contacts surface 4 of frame 2 in a position which enables edge 32 of retainer portion 28 to contact glass panel 6. Preferably retainer portion 28 is connected with surface 4 by means of nails which extend through openings 34 in retainer portion 28. In the window frame shown in FIG. 1 eight fastening elements 12 are used for retaining strip arrangement 10 and additional glass panel 8. However it is clear that the number required of fastening elements 12 is dependent on the size of frame 2.

Fastening elements 12 retain strip arrangement 10 with additional glass panel 8 in the position in which sealing portion 18 under suitable compression engages glass panel 6 allowing the free end of the legs 30 to engage shoulder 36 on main portion 14 of strip arrangement 10.

Because strip arrangement 10 requires a predetermined position in relation to fastening elements 12 in its mounted position and fastening elements 12 and sealing portion 18 of strip arrangement 10 are positioned in engagement with the same surface, i.e. one side surface of the glass panel 6, optimal compression of sealing portion 18 is provided very simply and enables tight engagement of the sealing portion against panel 6. Also because sealing portion 18 is provided engages a completely smooth surface there is provided an extremely good sealing of the space 26 between the glass panels 6 and 8.

Additional glass panel 8 is mounted by nailing fastening elements 12 to surface 4 of frame 2 in the position shown in FIG. 2 in which edge 32 of retainer portion 28 engages glass panel 6. Thus, the correct position of fastening elements 12 is provided without any special measuring operations. Strip arrangement 10 is mounted on the edge portion of the additional glass panel 8 by positioning the edge portion in groove 16 of main portion 14 of strip arrangement 10. It is therefore suitable to connect the edge portion of the glass panel 8 to the surfaces of the strip arrangement defining the groove 16 by for example, silicone glue. Finally the additional glass panel is positioned in window frame 2 by pushing legs 30 of fastening elements 2, which are resiliently depressed until the position shown in FIG. 2 has been reached, into the window opening sealing portion 18 being compressed against glass panel 6. Legs 30 of fastening elements 12 then assume a position in which the end surfaces of legs 30 engage shoulder 36.

If desired, it is possible to remove the additional glass panel 8 by moving legs 30 of fastening elements 12 away from engagement with shoulder 36 by use of any simple tool, for example a screwdriver.

The invention can be modified within the scope of the following claims.

I claim:

1. A device for fastening an additional glass panel into a window opening of a window frame comprising:

a strip arrangement having a base portion and a top portion, said base portion adapted to receive peripheral edge portion of the additional glass panel said top portion comprising a shoulder;

a sealing member connected to said top portion of said strip arrangement and adapted to sealingly engage an existing glass panel previously mounted in the window opening, a plurality of fastening elements for retaining said strip arrangement and said additional glass panel supported thereby in the window opening; said fastening elements comprising a retainer portion and a leg resiliently connected to said retainer portion at its lower end, said retainer portion being secured to an inner surface of the window frame, and comprising at its upper end an engagement portion adapted to contact the existing glass panel, said leg being adapted to snap into a position behind said shoulder on said strip arrangement; wherein contact of the engagement portions with the existing glass panel defines the position of the legs of the fastening elements on said strip arrangement so that the legs snap into said position behind the shoulder of the strip arrangement in a position thereof in which the sealing portion sealing engages the existing glass panel.

2. A device according to claim 1, wherein said strip arrangement comprises first and second portions, said first portion forming a groove for receiving the edge portion of the additional glass panel and said second portion forming the sealing portion of the strip arrangement.

* * * * *